US005992102A

United States Patent [19]

Ozawa

[11] Patent Number: 5,992,102

[45] Date of Patent: Nov. 30, 1999

[54] CELLULAR RESIN BLOCK AND STRUCTURAL UNIT FOR AN EXTERIOR STRUCTURE USING SUCH BLOCK

[75] Inventor: Tetuya Ozawa, Miyata-mura, Japan

[73] Assignee: Toyo Exterior Co., Ltd., Tokyo, Japan

[21] Appl. No.: 08/931,297

[22] Filed: Sep. 16, 1997

[30] Foreign Application Priority Data

Sep. 18, 1996 [JP] Japan ..... 8-267952

[51] Int. Cl.[6] ..... E04B 2/24; E04B 2/00; E04C 1/00

[52] U.S. Cl. ..... 52/100; 52/309.4; 52/309.14; 52/314; 52/437; 52/441; 52/424; 52/504; 52/505; 52/565; 52/592.6; 52/604; 52/606

[58] Field of Search ..... 52/309.4, 309.6, 52/309.7, 309.14, 314, 315, 504, 505, 604, 606, 592.6, 565, 429, 431, 437–440, 98, 100, 424

[56] References Cited

U.S. PATENT DOCUMENTS

| | | | |
|---|---|---|---|
| 2,745,276 | 5/1956 | Kuhlman | 52/100 |
| 3,552,076 | 1/1971 | Gregori | 52/438 X |
| 3,740,909 | 6/1973 | Stinnes | 52/315 X |
| 3,788,020 | 1/1974 | Gregori | 52/439 X |
| 3,905,170 | 9/1975 | Huettemann | 52/314 X |
| 4,075,808 | 2/1978 | Pearlman | 52/439 |
| 5,123,222 | 6/1992 | Guarriello et al. | 52/439 X |
| 5,465,542 | 11/1995 | Terry | 52/309.7 |
| 5,678,373 | 10/1997 | Franklin et al. | 52/606 X |
| 5,699,640 | 12/1997 | Bourgeois et al. | 52/606 X |
| 5,839,243 | 11/1998 | Martin | 52/439 |
| 5,855,102 | 1/1999 | Chang | 52/604 |
| 5,901,520 | 5/1999 | Abdul-Baki | 52/592.6 |
| 5,924,247 | 7/1999 | VanHorn et al. | 52/100 |

*Primary Examiner*—Robert Canfield
*Attorney, Agent, or Firm*—Ladas & Parry

[57] ABSTRACT

This invention is to provide a structure unit comprising a lightweight cellular resign block and plural bricks laid thereon. A cellular resign block 1 is integrally molded from suitable foamable resign so as to include vertical grooves 3 at the transversely opposite extremities, a vertical bar passage 5 at the transversely middle, and mortar wells 8 extending on the upper end of the block 1. Brick 20 is adhesively laid on surface of the block 1 using elastic mortar to form a structure unit A. Vertical reinforcing bars are inserted into vertical grooves 3 as well as into the middle vertical bar passage 5 and then mortal is poured into the mortar wells 8 to carry out work of masonry. For the blocks in every other stage, portions of vertical partitions 4 extending above the mortar wells 8 are broken away to form horizontal bar supports. Thus, a desired exterior structure such as wall, gatepost or the like in the same manner as with concrete blocks.

33 Claims, 7 Drawing Sheets

CELLULAR RESIN BLOCK AND STRUCTURAL UNIT FOR AN EXTERIOR STRUCTURE USING SUCH BLOCK

BACKGROUND OF THE INVENTION

1. Technical Field of the Invention

The present invention relates to a cellular resin block and a structural unit for an exterior structure using such block.

2. Description of the Related Prior Art

An exterior structure such as a wall which is exterior-finished with ceramic material, for example, tiles, bricks or the like, is usually erected in the field by a series of steps: forming a concrete body, then laying a plurality of bricks thereon by means of adhesive mortar and the filling the gaps between the bricks with joint mortar. Such field-works is troublesome and often requires a relatively long term to complete.

To avoid this, the structural units for said exterior structure could be prefabricated in a factory and then assembled at the site. However, in view of the weight of a structural unit, special machines including a crane which have been unusual in such works must be used to place the structure units on the site.

In view of the situation as has been mentioned above, it is a principal object of the invention to provide a cellular resin block and a structural unit for exterior structure using such blocks. As a result, the building of the exterior structure of the above-mentioned type is simplified because workers can build the exterior structure easily and reliably within a relatively short period of time and without the need to use any special machines.

SUMMARY OF THE INVENTION

To achieve the object set forth above, the invention provides a light-weight cellular resin block replacing the concrete block of well known art and a structure unit using such cellular resin block. It will be easy for the operators skilled in masonry of concrete blocks to form a structure body from a plurality of the cellular resin blocks 1 and then to provide this structure body with exterior finish, or to construct a desired exterior structure directly from said structure unit. Concerning formation of the cellular resin block itself, the invention aims to reduce an amount of resin used for formation of each block and to realize a lightweight block with an adequate strength. This is achieved, according to the invention, by providing plural vertical partitions between a pair of base plates back-and-forth opposed to each other so as to connect these base plates. The vertical partitions define plural vertical passages extending between said pair of base plates and thereby to increase a void content. An increased void content will increase an amount of mortar for work of masonry since a portion of mortar tends to flow into said vertical passages. To avoid this, limited number of said vertical passages necessary for arrangement of vertical reinforcing bars are used as vertical bar passages completely extending through the block and the remaining vertical passages are formed as closed vertical cavities so that a flowing amount of mortar minimized. In view of the fact that the cellular resin can be easily broken, said closed vertical cavities are adapted to be broken through and thereby used as additional vertical bar passages when an actual situation at the site of work requires it. Specifically, when said vertical bar passages are not aligned with said initially opened vertical bar passages, said closed vertical cavities may be selectively broken through to be used as the additional vertical bar passages.

Various aspects of the present invention will be described with reference to the appended Claims.

The invention relates to a cellular resin block integrally molded from suitable foamable resinous material, said cellular resin block comprising a pair of base plates back-and-forth opposed to each other, plural vertical partitions connecting said pair of base plates, two of said vertical partitions provided at transversely opposite extremities of the block defining a pair of vertical grooves respectively, adapted to form vertical bar passages in combination with the corresponding vertical grooves of the other two blocks as these two blocks are butted from both sides against the first-mentioned block, said vertical partitions defining plural vertical passages between said vertical grooves, vertical bar passages completely extending through the block formed by selective one or more of said plural vertical passages defined by said partitions, and mortar well bottom walls horizontally extending across the remaining vertical passages of said plural vertical passages defined by said vertical partitions at a level above their vertically middle level so as to form mortar wells above said remaining vertical passages and simultaneously to form closed vertical cavities adapted to be optionally used as additional vertical bar passages by breaking through the corresponding mortar well bottom walls. The hereby characterized arrangement substantially achieves the object set forth above.

The invention relates to a cellular resin block wherein there is provided a single vertical bar passage completely extending through the block in order to facilitate work of masonry in accordance with The standard arrangement of reinforcing bars and this single vertical bar passage is formed by transversely middle one of said plural vertical passages defined by said plural vertical partitions.

The invention relates to a cellular resin block wherein at least those of said plural vertical partitions provided at transversely opposite extremities of the block extend along substantially full height of the base plates between them; and wherein at least portions of said vertical partitions extending above said mortar well bottom walls can be broken away only when it is required to support a horizontal reinforcing bar to form horizontal bar supports above said mortar well bottom walls. Such arrangement allows work of masonry to be stabilized and thereby allows a load of structure to be reliably supported.

The invention relates to a cellular resin block wherein said base plates back-and-forth opposed to each other or plural vertical partitions are provided at their upper and lower ends with positioning configurations in the form of indentations adapted to be engaged with those of adjacent blocks. Such arrangement improves a work efficiency of masonry.

The invention relates to a structure-unit for exterior structure comprising the cellular resin blocks wherein a plurality of bricks are adhesively laid on surfaces of said base plates back-and-forth opposed to each other. Such arrangement allows these cellular resin blocks to be used for work of masonry at the site and thereby allows a quakeproof exterior structure to be constructed as directly as possible.

The invention relates to a structure unit for exterior structure wherein the adhesively laying of the bricks on the surface of the base plates is achieved by pressing the bricks against a layer of adhesive mortar applied on said surfaces of the base plates. Such arrangement prevents the surface of the cellular resin block from being exposed and thereby the exterior structure can be finished with good appearance.

The invention relates to a structure unit for exterior structure wherein said layer of adhesive mortar is squeezed out to form a bulging joint between each pair of adjacent bricks as the bricks are pressed against said layer of adhesive mortar applied on said surfaces of the base plates. Such arrangement eliminates a demand for separately carrying out work of bulging joint formation using joint mortar and improves a finish appearance.

Finally, the invention relates to a structure unit for exterior structure wherein said adhesive mortar is elastic mortar. Use of elastic mortar as said adhesive mortar is effective to protect the structure unit against generation of cracks in the layer of adhesive mortar and peel-off of the adhesive mortar itself, particularly of the bricks as well as the joint due to vibration and/or thermal expansion and contraction of the structure unit, for example, during transport, since vibration exerted directly on the adhesive mortar can be absorbed by the cellular resin block as completely as possible.

DESCRIPTION OF THE PREFERRED EMBODIMENT

Figure 1:
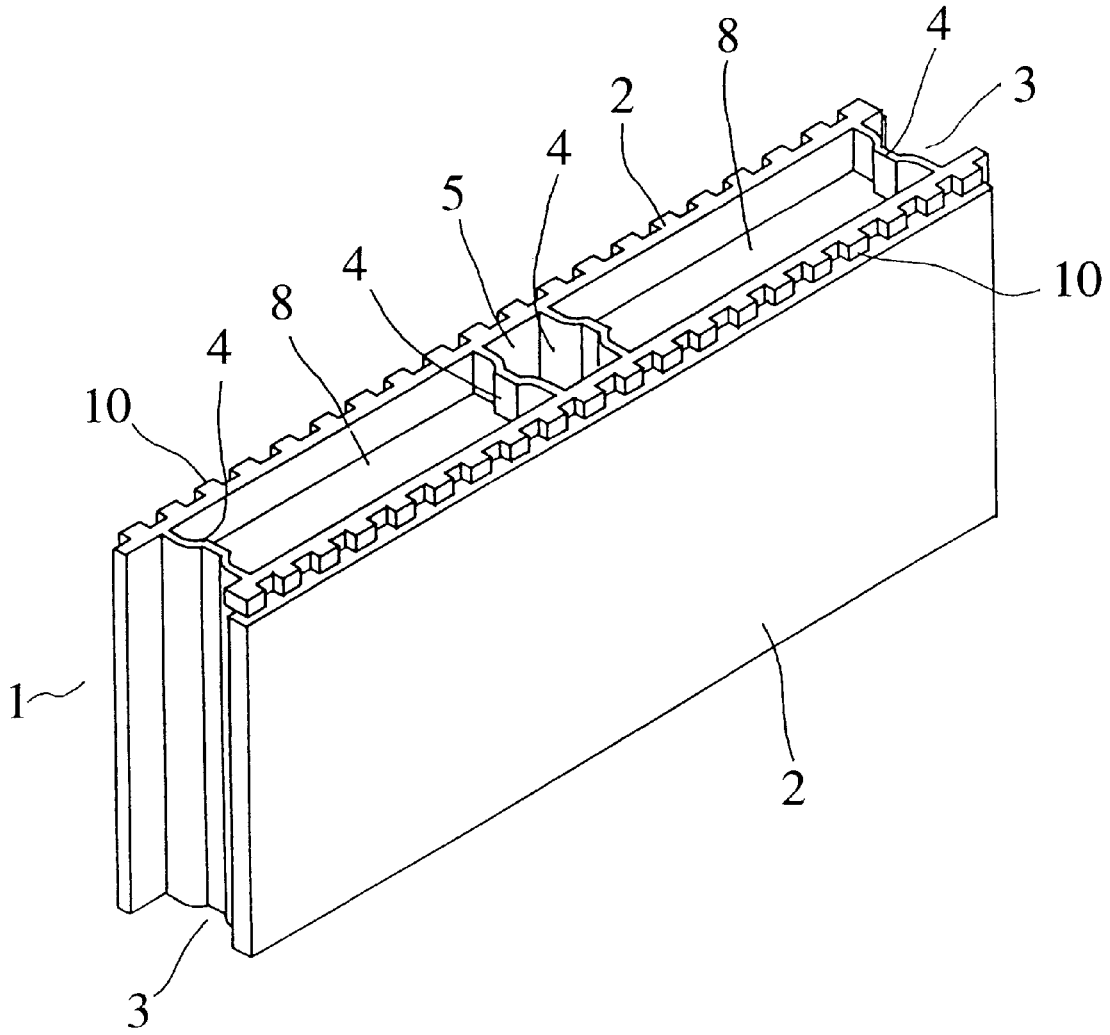
FIG. 1 is a perspective view of a cellular resin block.
Figure 2:
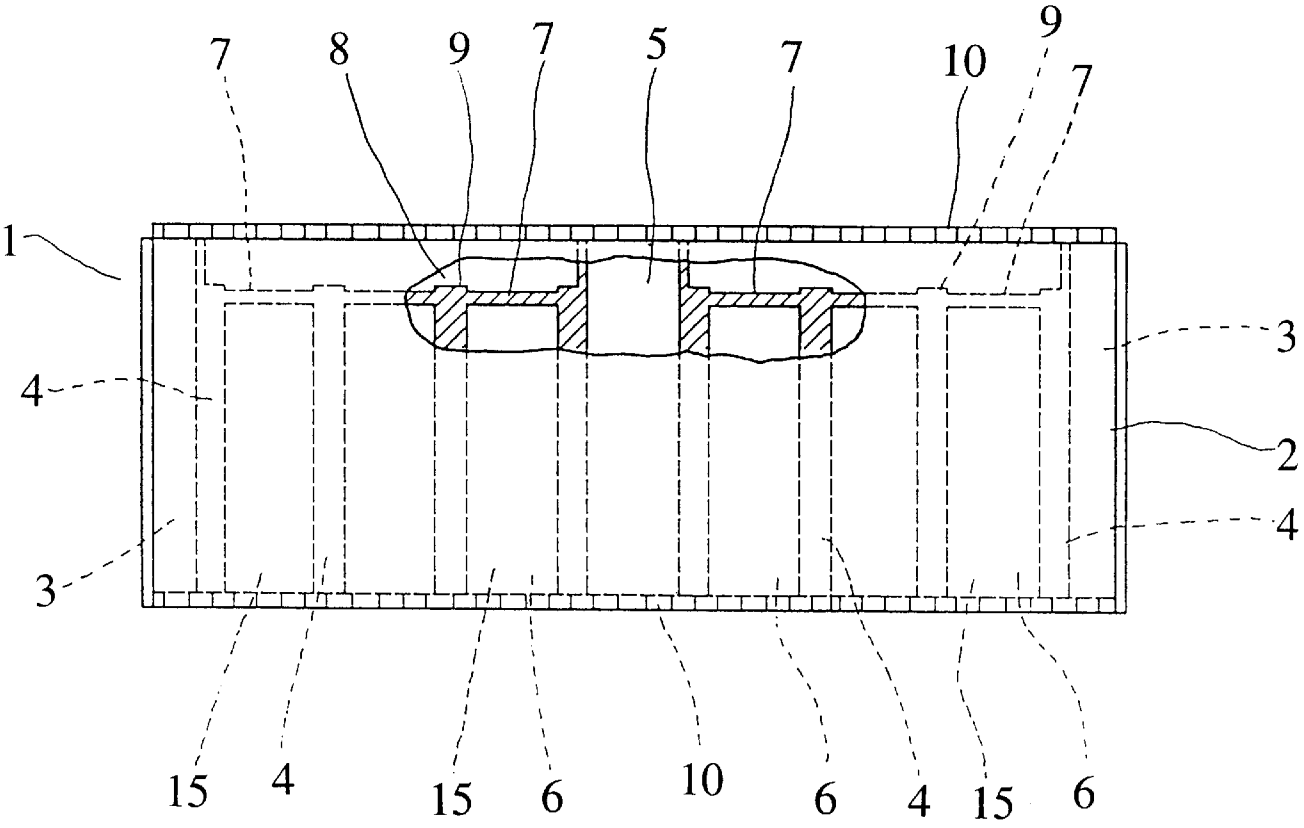
FIG. 2 is a front view of the cellular resin block shown as partially broken away.
Figure 3:
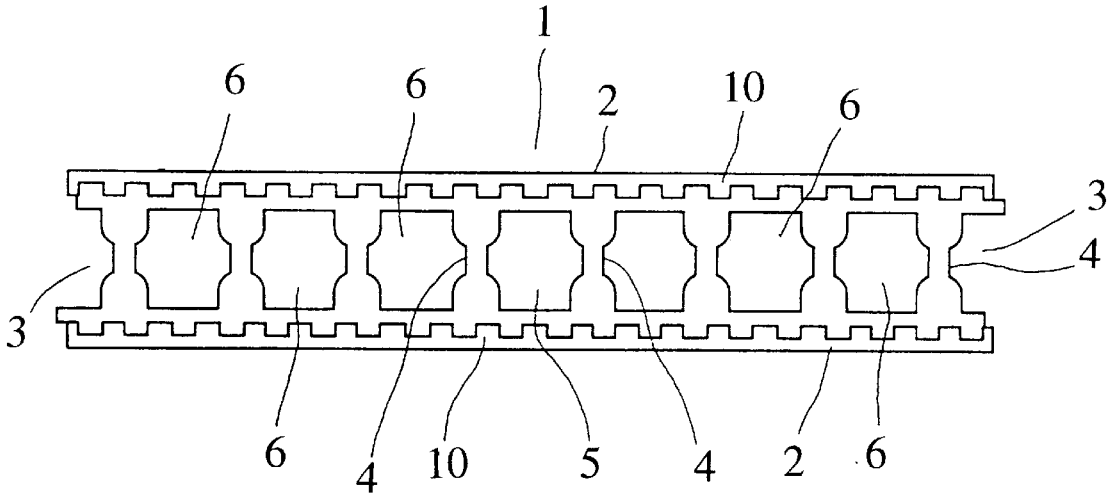
FIG. 3 is a bottom view of the cellular resin block.
Figure 4:
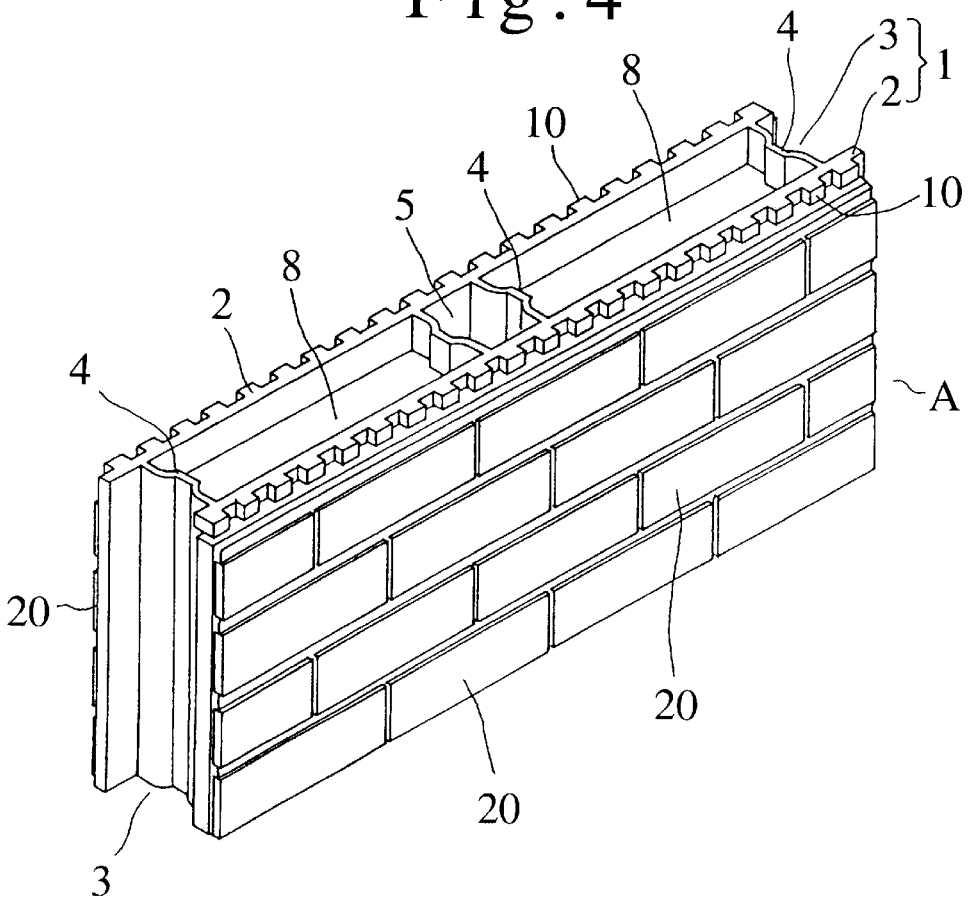
FIG. 4 is a perspective view of an exterior structure unit.
Figure 5:
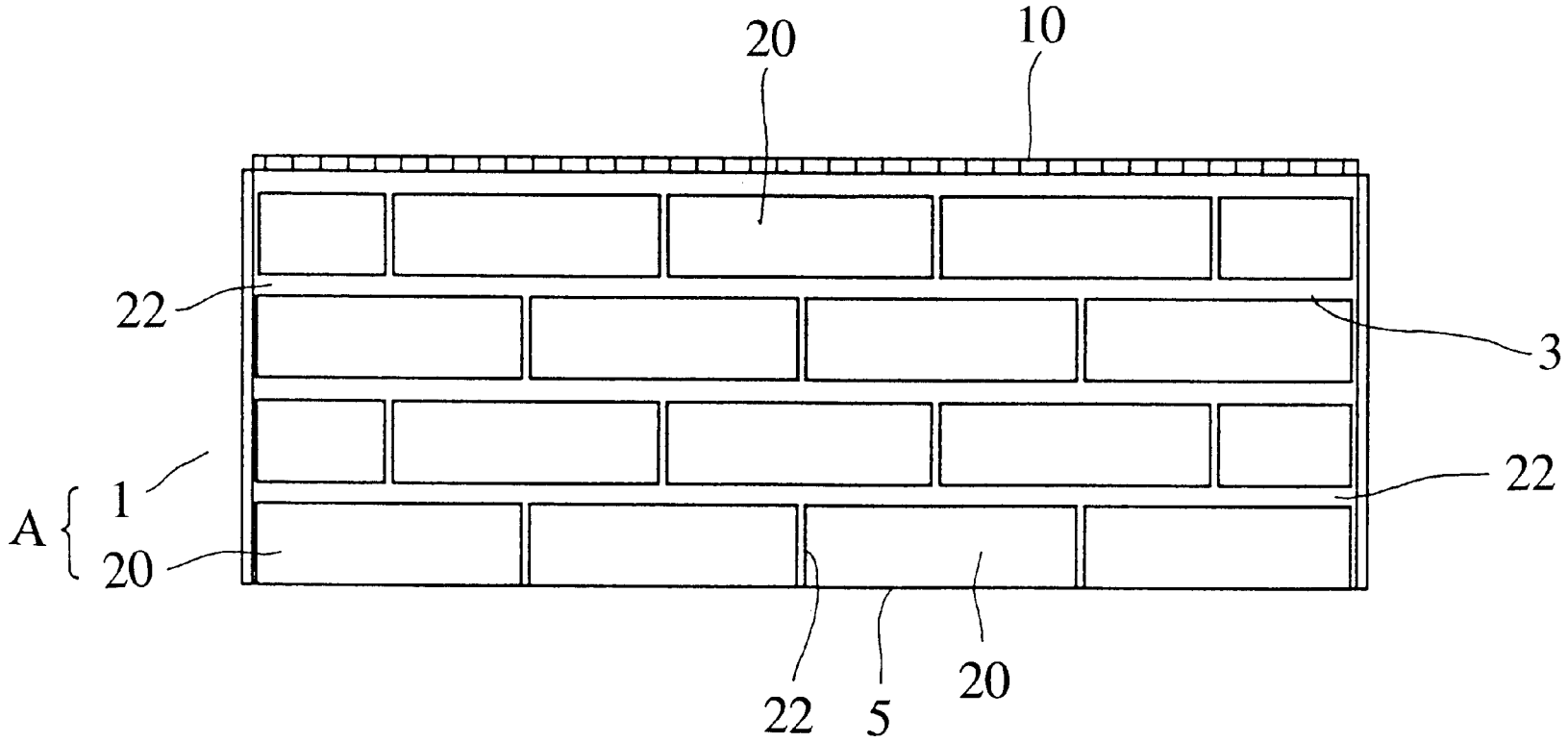
FIG. 5 is a front view of the exterior structure unit.
Figure 6:
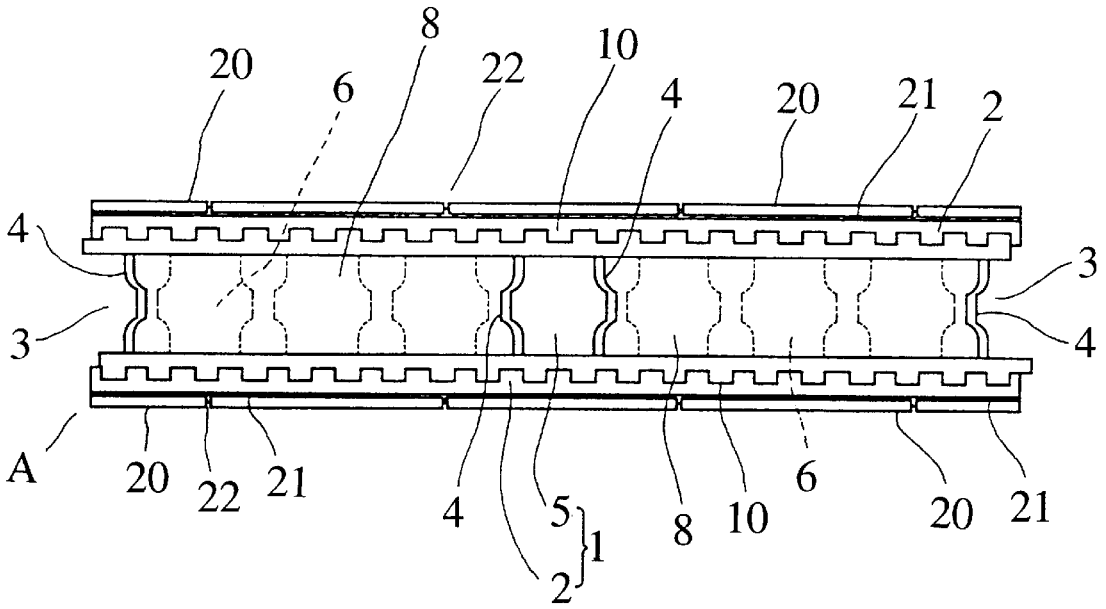
FIG. 6 is a plan view of the exterior structure unit.
Figure 7:
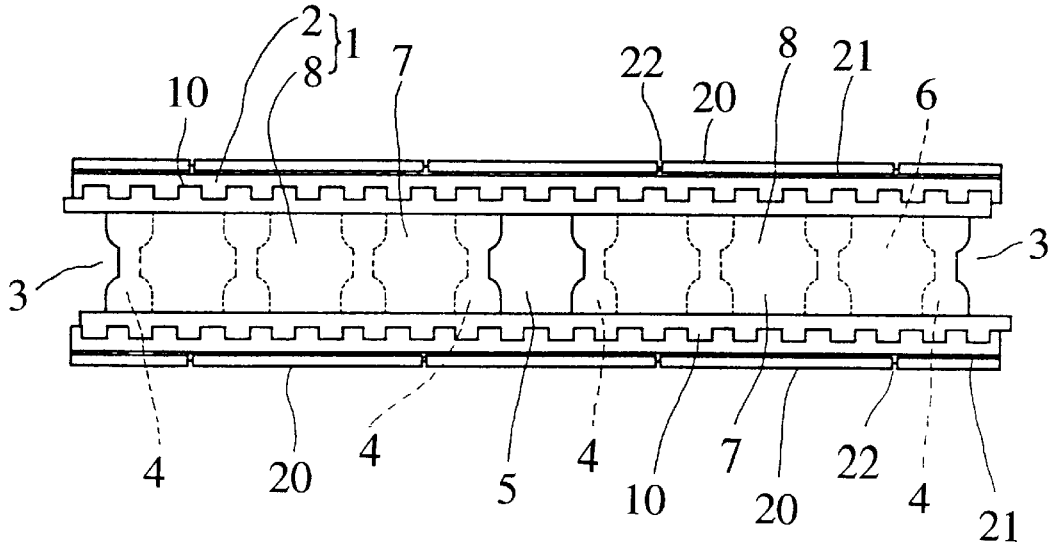
FIG. 7 is a plan view of the exterior structure unit with partitions broken away.
Figure 8:
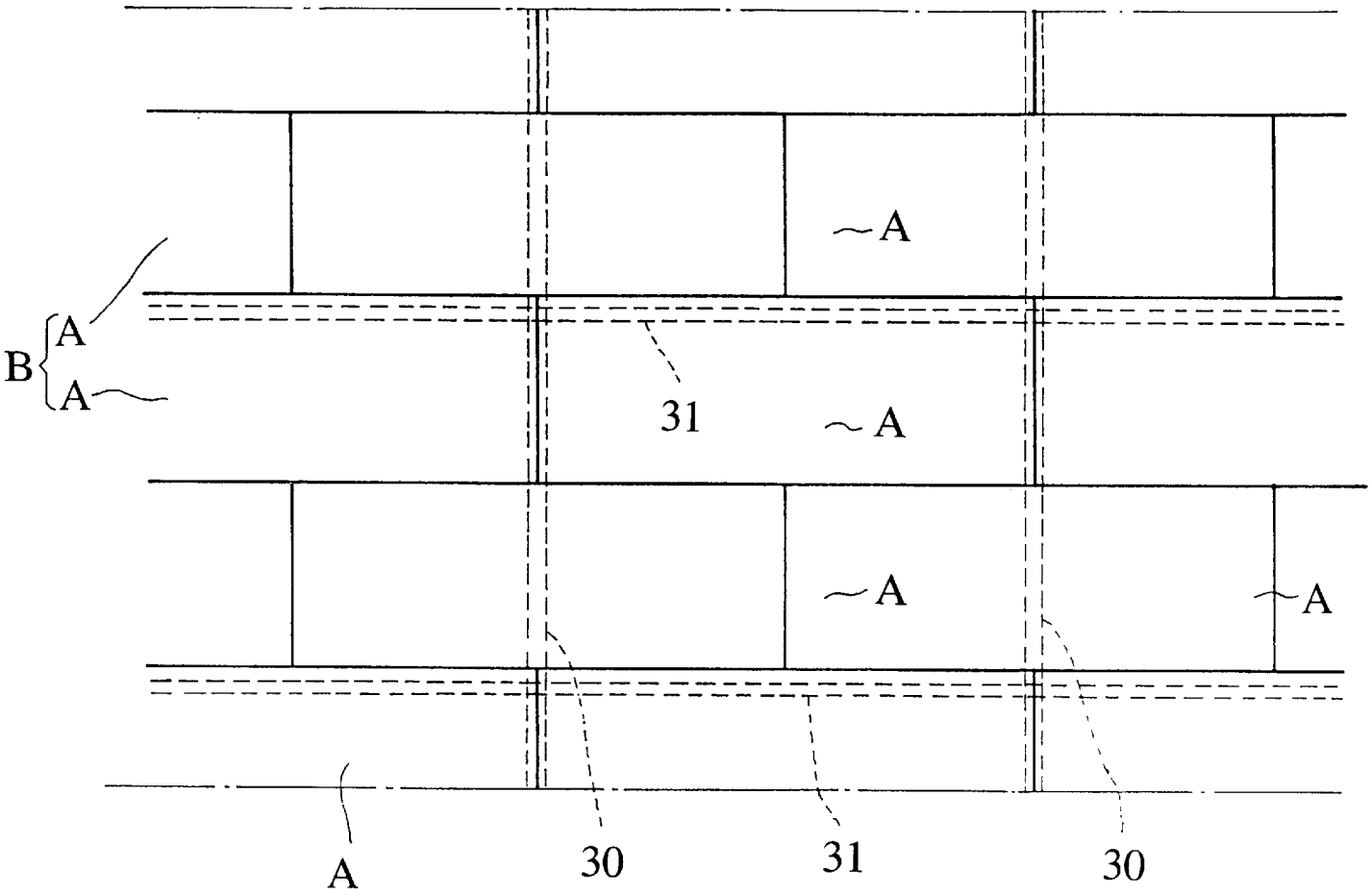
FIG. 8 is a front view illustrating a relationship between the exterior structure unit and a bar arrangement therein.

Details of the invention will be more fully understood from the following description of the embodiments given hereunder in reference with the accompanying drawings.

Referring to FIGS. 1 through 8, reference letter A designates a unit of exterior structure B comprising, in turn, a cellular resin block 1 carrying plural bricks 20 adhesively laid on its surfaces. The cellular resin block 1 in the structural unit A is integrally molded from cellular resin and comprises front and rear base plates 2 opposed to each other, plural vertical partitions 4 interposed between said base plates 2 so as to define plural vertical vertical passages 15 for vertical bars between a pair of said partitions provided adjacent transversely opposite ends of the block 1. These partitions on the opposite extremities of the block 1 respectively have vertical grooves 3 configured to complete the vertical passages 15, respectively, in cooperation with the corresponding vertical grooves 3 of additional blocks 1 butt-joined to the transversely opposite extremities of the first-mentioned block 1. A selective one of said plural vertical passages 15 defined by said partitions 4 is used as a vertical bar passage 5 completely extending through the block while the remainder passages 15 are closed adjacent their upper ends so as to form mortar wells 8 horizontally extending across their tops and simultaneously to define closed vertical cavities 6 which can be optionally broken through and used as additional passages 5 for vertical bars. Reference numeral 7 designates bottom walls of respective mortar wells 8. According to the specific embodiment shown, a transversely middle one of said plural passages 15 defined by said plural partitions 4 is used as said vertical passage 5 completely extending through the block. Of said plural partitions 4, at least those provided at the transversely opposite ends of the block extend between the pair of base plates 2 opposed to each other substantially along the full height of these base plates 2. At least portions of the partitions 4 extending above said mortar well bottoms 7 may be cut off to form horizontal bar supports 9. Said pair of base iplates 2 opposed to each other or said plural partitions 4 are provided at their vertical opposite ends with positioning configurations 10 adapted for engagement with the corresponding configurations 10 of vertically adjacent blocks.

The cellular resin block 1 according to this embodiment comprises a rectangular block integrally molded from foamable resin dimensioned to have a height of 30 cm, a length (width) of 80 cm and a thickness of 15 cm. To achieve a high body strength (core strength) in the exterior structure B comprising light-weight blocks, polyethylene is foamed at an expansion ratio of 30 to obtain cellular polystyrene blocks.

The cellular resin block 1 according to the present embodiment comprises said mutually opposed base plates 2 each having a thickness of 33 mm between which eight vertical partitions 4 are arranged at a regular pitch, leaving spaces defining vertical grooves 3 at transversely opposite ends of the block. Each of the vertical partitions 4 is dimensioned so to have a thickness of 40 mm at its vertically opposite ends thereof and a thickness of 20 mm at its middle so as to present a pounder-like sectional shape. The vertical partitions 4 provided adjacent the transversely opposite ends as well as the vertical partition 4 provided at the middle thereof extend along substantially full height of the base plates 2. The remaining vertical partitions 4 have their top ends at a level 50 mm below the top ends of the base plates 2 and define seven vertical cavities is each substantially octagonal in cross-section 15 between said vertical grooves 3, 3 left at said transversely opposite ends of the block.

As has previously been described, said vertical passage 15 provided at the transversely middle is selected from said plural vertical passages 15 as the vertical passage 5 defined between a pair of adjacent vertical partitions 4 extending along substantially full height of the block and completely extending therethrough. The remaining vertical passages 15 are closed at the level 50 mm below the tops of said base plates 2 by the plate-like mortar well bottom walls 7 horizontally extending across the respective vertical partitions 4 so as to form the groove-like mortar wells 8 having a depth of 50 mm between the pair of base plates 2.

Said vertical partitions 4, particularly the vertical partitions 4 extending along the substantially full height of the block as well as said mortar well bottom walls 7 form a part of the cellular resin block 1 and are uniquely dimensioned. More specifically, the upper thinned portions of said pounder-shaped vertical partitions 4 extending along the substantially full height of the block and said plate-like mortar well bottom walls 7 are appropriately dimensioned, for example, to have a thickness of 10 mm. In this manner, the portions of said vertical partitions 4 extending above said mortar wells 8 can be easily broken away using tools, cutters or the like in order to form supports 9 for a horizontal bar 31 extending transversely of the block above said mortar well bottom walls 7. Similarly, said mortar well bottom walls 7 can be easily broken through in order to open the cavities 6 and thereby to use them as the additional vertical passages completely extending through the block for insertion of vertical bars 30. Thus, such breaking away and/or breaking through may be optionally done to obtain said horizontal bar supports 9 and/or said additional vertical passages 6 for insertion of vertical bars 30.

A positioning indentation 10 formed in upper end of each base plate 2 is directed outward while the positioning indentation 10 formed in lower end of each base plate 2 is directed inward. The indentation 10 in the upper end of the base plate 2 is formed in a staggered relationship with respect to the indentation 10 in the lower end of the base plate 2. These indentations 10 not only facilitate stacking the blocks 1 without misalignment of same, since said indentations of the respective adjacent blocks are engaged one with another so as to assure relative positions of the respective blocks not only transversely but also back and forth.

A number of bricks 20 may be adhesively applied on the surfaces of the respective base plates 2 opposed to each other of said resin plastic block 1 to obtain the structural unit A. In the case of the present embodiment, adhesive application of the bricks 20 on the surface of each base plate 2 is performed by pressing these bricks 20 against a layer of adhesive mortar 21 applied on said surface of the base plate. A bulging joint 22 is formed between each pair of adjacent bricks 20 as these bricks 20 are pressed against said layer of adhesive mortar 21. As said adhesive mortar 21, elastic mortar is used in this embodiment.

Each of said bricks 20 used in this embodiment has a height of 60 mm, a length (width) of 197 mm and a thickness of 10 mm. Such bricks 20 are adhesively applied on the front and rear base plates 2, for example, in a staggered pattern, so as to form between each pair of adjacent bricks 20 a joint 22 extending transversely with a width of 15 mm and vertically with a width of 3 mm. Such joint 22 is a so-called bulging joint formed as the bricks 20 are pressed against the layer of adhesive mortar 21 applied on the surfaces of the base plates 2.

The adhesive mortar 21 is applied on the entire surface of the base plate 2 to form a layer which is approximately 3 mm thick and then the respective bricks 20 are pressed against to this layer so that an amount of the adhesive mortar squeezed under the pressure forms a 4~5 mm wide bulging joint between each pair of adjacent bricks 20. In this way, the cellular plastic block 1 has its surfaces of the base plates 2 entirely covered with the adhesive mortar 21 for adhesively fixing the bricks 20 thereto and thereby protected against deterioration due to exposure to weather. Additionally, the operation of adhesively fixing the bricks 20 simultaneously forms said bulging joint 22 and thus saves labor and time which otherwise would be required for separately forming such joint using so-called joint mortar.

As the adhesive mortar 21, the elastic mortar based on acrylic resins, preferably, alkylester acrylate copolymer (solid content: 57%) is employed. The adhesive mortar 21 of such type advantageously bestows the adhesive mortar 21 with high adhesiveness and elasticity (flexibility). The high adhesive/elastic mortar thus obtained presents various desired characteristics. For example, it absorbs vibration caused during transport of the blocks as well as thermal expansion/contraction due to direct rays of the sun and therefore neither crack nor peel-off occurs. Particularly, peel-off of the bricks 20 and the joint 22 can be reliably avoided.

The structure units A herein described as the embodiment can be stacked using reinforcing bars and mortar as in the usual masonry work of concrete blocks to form a desired exterior structure B such as a gatepost or wall.

In the case of the present embodiment, a plurality of structure units A are stacked in staggered arrangement and then are fixedly connected vertical bars 30 as well as horizontal bars 31 with mortar poured therearound. Exposed top surfaces of the uppermost structure units A in the stack and side surfaces of the structure units A arranged at one or opposite side ends may be finished, for example, by adhesively laying bricks 20 on these exposed surfaces.

More specifically to describe a relationship between the structure units A and the vertical reinforcing bars 30, the work begins, as it is usual, with arranging the vertical reinforcing bars 30 upright on the ground surface at a pitch of 80 cm. On the other hand, the structure units A are placed side by side to butt against one another so that the vertical grooves 3 extending along the opposite side edges of the respective cellular plastic blocks 1 may complete the vertical bar passages 5. Then the vertical reinforcing bars 30 are alternately inserted into said vertical bar passages 5 formed by the respective pairs of adjacent vertical grooves 3 and the vertical passages 5 initially provided through the middle of the cellular plastic blocks 1, followed by pouring the mortar into these vertical passages 5. Depending on the pitch and locations at which the vertical reinforcing bars 30 are arranged, it may happen that the bars 30 are not aligned with said vertical bar passages 5. To overcome such problem of misalignment, the appropriate one of the mortar well bottom walls 7 may be broken through and thereby the corresponding cavity 6 may be used in the same manner as said vertical bar passages. Now a relationship between the structure units A and the horizontal reinforcing bars 31 will be described. It is assumed here that the horizontal reinforcing bars 31 are arranged in every other stage of the structure units A. The horizontal bars 31 bound together with said vertical bars 30 at their intersecting points are received by the horizontal bar supports 9 formed by partially breaking the corresponding partition 4 and then the mortar is poured into the mortar wells 8. Then such stage is stacked on the underlying stage of the structure units A containing no horizontal bars 31. This underlying stage of the structure units A have their partitions 4 not broken away and their mortuary wells 8 filled with the mortar so that a portion of the mortar may rise into the respective vertical passages of the cellular plastic blocks 1 in the stage of the structure units A overlying said stage of the structure units A containing no horizontal bar 31 as the former is stacked upon the latter. By repeating such procedure, a desired exterior structure B can be easily and reliably constructed. In this manner, the structure units A are fixedly connected one to another by the arrangement of bar reinforcement and the mortar. In addition, a combination of the cellular resin blocks used as the structure units A with the elastic mortuary used to adhesively lay the bricks on said blocks is effective to absorb a seismic vibration and thereby to ensure a high seismic resistance.

Figure 9:
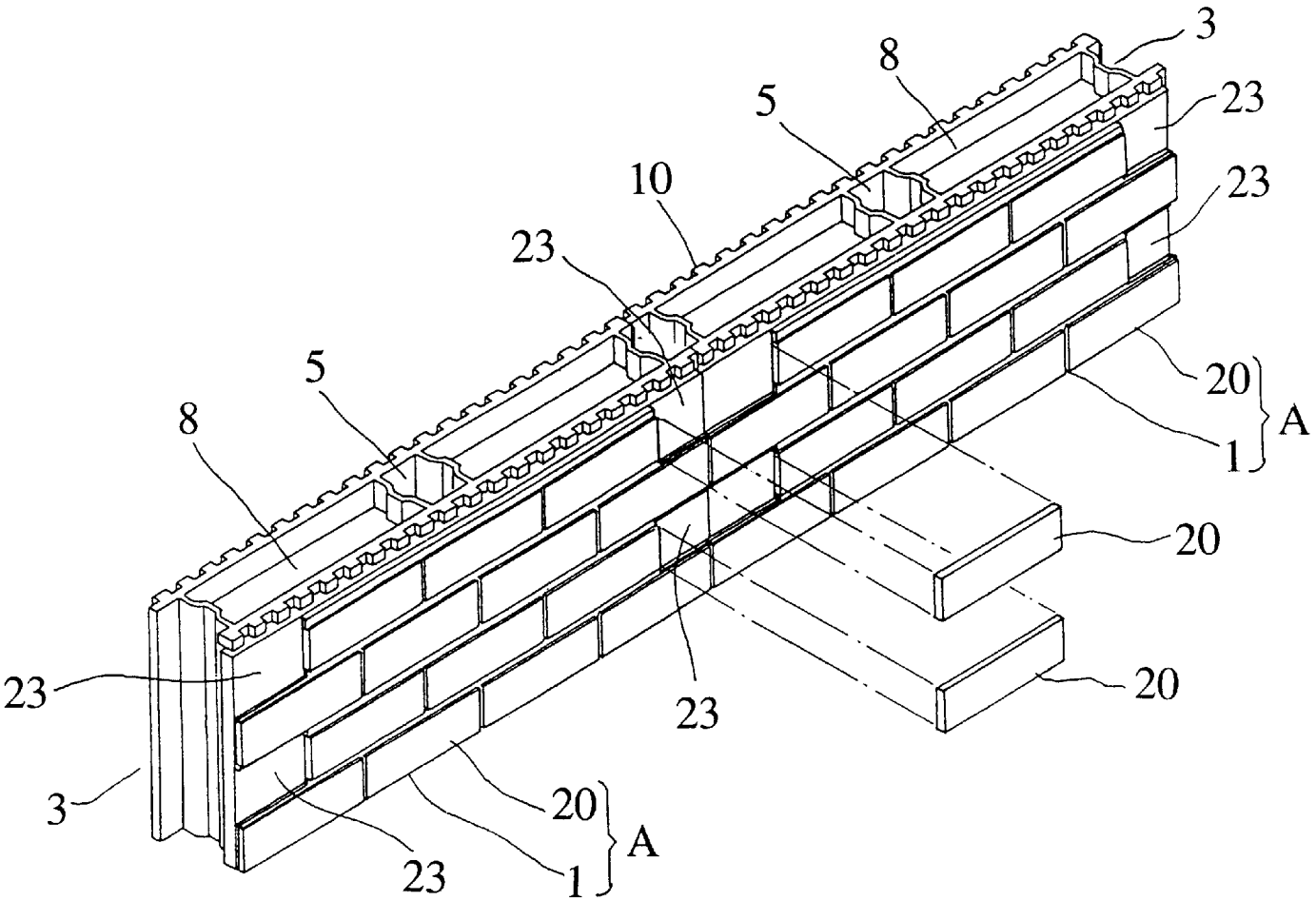
FIG. 9 is a perspective view showing a variant of the exterior structure unit.

FIG. 9 illustrates a variant of the structure unit A and particularly a variant of the manner in which the bricks 20 are adhesively laid on the unit A. According to this alternative embodiment, the bricks 20 are adhesively laid on the unit A every other stage at transversely opposite ends of the unit A so that brick-free zones 23 each having a width corresponding to ½ width of the individual brick 20 are defined every other stage at said transversely opposite ends of the unit A. If the half-width bricks are laid in said brick-free zones 23, these half-width bricks would stand out and lack harmony. To avoid this, after each pair of the structure units A arranged side by side have been connected to each other, the full-width brick 20 may be post-laid in each full-width zone completed by each brick-free zone 23 on one structure unit A and the corresponding brick-free zone 23 on the other structure unit A precisely aligned and contiguous with each other. Thus, so-called horse joint (also referred to as horse footprint joint) is formed over the entire surface of the exterior structure B as seen in FIG. 9.

As will be apparent from the foregoing description, the present invention has been developed to provide a structure unit comprising a lightweight cellular resin block and plural bricks laid thereon.

According to a specific embodiment, a cellular resin block 1 is integrally molded from suitable foamable resin material so as to include vertical grooves 3 at the transversely opposite extremities a vertical bar passage 5 at the transversely middle, and mortar wells 8 extending on the upper end of the block 1. Brick 20 are adhesively laid on surface of the block 1 using elastic mortar to form a structure unit A. Vertical reinforcing bar are inserted into the vertical grooves 3 as well as into the middle vertical bar passage 5 and then mortar is poured into the mortar wells 8 to carry out work of masonry. For the blocks in every other stage, portions of vertical partitions 4 extending above the mortar wells 8 are broken away to form horizontal bar supports. Thus, a desired exterior structure such as wall, gatepost or the like in the same manner as with concrete blocks.

While the specific embodiments have been described in reference with the accompanying drawing, the invention is not limited to these embodiments but may be carried out in other various manners. For example, the cellular resin block may be configured merely to be used in the place of the concrete block. In this case, after a structure unit has previously been formed, work of exterior finish such as adhesively laying of the bricks may be performed on the site to complete a desired exterior structure. A plurality of the vertical bar passages may be formed by selectively breaking through the plural vertical cavities previously arranged transversely of the block. Upper portions of the vertical partitions may be configured as side walls of the respective mortar wells so as to be used no matter whether it is required to support the horizontal bar. For the vertical partitions extending along substantially full height of the base plates, the upper portions thereof may have a thickness equal to or lager than the thickness of the remaining portions so far as a desired breakability is maintained. When the positioning configurations are formed at upper and lower ends of the block, the base plates and/or the vertical partitions may be extended up-and downward to provide them. The positioning configurations may be provided also along the transversely opposite ends of the block in the form of indentations.

The base plates of the block may be previously formed with recesses adapted to receive the bricks laid thereon and thereby a work efficiency at the site may be improved.

Concerning the structure units, those destined to be placed at upper end, destined to be placed at side end, etc., may be previously formed and exterior-finished by adhesively laying the bricks. In addition, the other factors such as specific material, shape, configuration, dimensions, number mutual relationship, and specific applications may be optional without departing from the spirit and the scope of the invention.

What is claimed is:

1. Cellular resin block integrally molded from a foamable resinous material, said cellular resin block comprising a pair of base plates opposed to each other, plural vertical partitions connecting said pair of base plates, two of said vertical partitions provided at transversely opposite extremities of the block defining a pair of vertical grooves, respectively, adapted to form a portion of a vertical bar passage, said vertical partitions also defining plural vertical passages between said vertical grooves, at least one vertical bar passage completely extending through the block and mortar well bottom walls horizontally extending across the remaining vertical passages defined by said vertical partitions at a level above their vertically middle level so as to form mortar wells above said remaining vertical passages and simultaneously to form closed vertical cavities adapted to be optionally used as additional vertical bar passages by breaking through the corresponding mortar well bottom walls.

2. Cellular resin block according to claim 1, wherein there is provided a single vertical bar passage completely extending through the block and said single vertical bar passage is formed by a transversely middle one of the vertical passages defined by said plural vertical partitions.

3. Cellular resin block according to claim 1, wherein at least those of said plural vertical partitions provided at transversely opposite extremities of the block extend along substantially full height of the base plates between them; and wherein at least portions of said vertical partitions extending above said mortar well bottom walls can be broken away to form horizontal bar supports above said mortar well bottom walls.

4. Cellular resin block according to claim 1, wherein said base plates opposed to each other are provided at their upper and lower ends with positioning configurations in the form of indentations adapted to be engaged with those of adjacent blocks.

5. Structure unit for exterior structure comprising a plurality of cellular resin blocks according to claim 1, wherein a plurality of bricks are adhesively laid on surfaces of said base plates.

6. Structure unit for exterior structure according to claim 5, wherein the adhesively laying of the bricks on the surfaces of the base plates is achieved by pressing the bricks against a layer of adhesive mortar applied on said surfaces of the base plates.

7. Structure unit for exterior structure according to claim 6, wherein said layer of adhesive mortar is squeezed out to form a bulging joint between each pair of adjacent bricks as the bricks are pressed against said layer of adhesive mortar applied on said surfaces of the base plates.

8. Structure unit for exterior structure according to claim 6, wherein said adhesive mortar is elastic mortar.

9. Cellular resin block according to claim 2, wherein at least those of said plural vertical partitions provided at transversely opposite extremities of the block extend along substantially full height of the base plates between them; and wherein at least portions of said vertical partitions extending above said mortar well bottom walls can be broken away to form horizontal bar supports above said mortar well bottom walls.

10. Cellular resin block according to claim 2, wherein said base plates are provided at their upper and lower ends with positioning configurations in the form of indentations adapted to be engaged with those of adjacent blocks.

11. Cellular resin block according to claim 3, wherein said base plates are provided at their upper and lower ends with positioning configurations in the form of indentations adapted to be engaged with those of adjacent blocks.

12. Structure unit for exterior structure comprising a plurality of cellular resin blocks according to claim 2, wherein a plurality of bricks are adhesively laid on surfaces of said base plates opposed back and forth to each other.

13. Structure unit for exterior structure comprising a plurality of cellular resin blocks according to claim 3, wherein a plurality of bricks are adhesively laid on surfaces of said base plates opposed back and forth to each other.

14. Structure unit for exterior structure comprising a plurality of cellular resin blocks according to claim 4, wherein a plurality of bricks are adhesively laid on surfaces of said base plates opposed back and forth to each other.

15. Structure unit for exterior structure according to claim 7, wherein said adhesive mortar is elastic mortar.

16. Cellular block comprising:

(a) a pair of base plates opposed to each other;

(b) plural vertical partitions disposed between said pair of base plates;

two of said vertical partitions being provided at transversely opposite extremities of the block defining a pair of vertical grooves respectively adapted to form vertical bar passages when used in combination with corresponding vertical grooves of two of the blocks butted on both sides against the cellular block;

said vertical partitions also defining plural vertical passages between said vertical grooves;

one or more of said plural vertical passages defined by said vertical partitions forming vertical bar passages extending through the block; and (c) mortal well bottom walls horizontally extending across a number of the vertical passages defined by said vertical partitions.

17. Cellular block according to claim 16 wherein the mortal well bottom walls are adapted to be broken through thereby making the vertical passage across which a bottom wall extended available as an additional vertical bar passage.

18. Cellular block according to claim 16 wherein there is provided a single vertical bar passage extending through the block, said single vertical bar passage being formed by a middle one of the vertical passages defined by said plural vertical partitions.

19. Cellular block according to claim 16 wherein at least those of said plural vertical partitions provided at transversely opposite extremities of the block extend along substantially a full height of the base plates, at least those portions of said vertical partitions extending above said mortal well bottom walls can be broken away to form horizontal bar supports on or above said mortal well bottom walls.

20. Cellular block according to claim 16 wherein the cellular block is molded from a resinous material.

21. Cellular block according to claim 16 wherein the cellular block is molded from a foamable resinous material.

22. Cellular block according to claim 16 wherein said base plates are provided at their upper and lower ends with positioning arrangements adapted to be engaged with those of adjacent blocks.

23. Cellular block according to claim 16 wherein a plurality of external items are adhesively bonded to expose surfaces of said base plates.

24. Cellular block according to claim 23 wherein the items are bricks and wherein the adhesively laying of the bricks on the surfaces of the base plates is achieved by pressing the bricks against a layer of adhesive mortar applied on said surface of the base plates.

25. Cellular block according to claim 24 wherein said layer of adhesive mortar is squeezed out to form a bulging joint between each pair of adjacent bricks as the bricks are pressed against said layer of adhesive mortar applied on said surfaces of the base plates.

26. Cellular block according to claim 23 wherein said adhesive mortar 21 is elastic mortar.

27. Cellular resin block according to claim 17, wherein at least those of said plural vertical partitions provided at transversely opposite extremities of the block extend along substantially full height of the base plates between them; and wherein at least portions of said vertical partitions extend above said mortar well bottom walls can be broken away to form horizontal bar supports above said mortar well bottom walls.

28. Cellular resin block according to claim 17, wherein said base plates are provided at their upper and lower ends with positioning configurations in the form of indentations adapted to be engaged with those of adjacent blocks.

29. Cellular resin block according to claim 18, wherein said base plates are provided at their upper and lower ends with positioning configurations in the form of indentations adapted to be engaged with those of adjacent blocks.

30. Cellular resin block according to claim 17 wherein a plurality of bricks are adhesively laid on surfaces of said base plates.

31. Cellular resin block according to claim 18 wherein a plurality of bricks are adhesively laid on surfaces of said base plates opposed back and forth to each other.

32. Cellular resin block according to claim 19 wherein a plurality of bricks are adhesively laid on surfaces of said base plates opposed back and forth to each other.

33. Cellular resin block according to claim 22 wherein said adhesive mortar is elastic mortar.

* * * * *